US009301558B2

(12) United States Patent
Schlager

(10) Patent No.: US 9,301,558 B2
(45) Date of Patent: Apr. 5, 2016

(54) CARDIOPULMONARY LIGHTNING PROTECTION GARMENT

(76) Inventor: Dan Schlager, Tiburon, CA (US)

( * ) Notice: Subject to any disclaimer, the term of this patent is extended or adjusted under 35 U.S.C. 154(b) by 1001 days.

(21) Appl. No.: 13/468,069

(22) Filed: May 10, 2012

(65) Prior Publication Data

US 2013/0298319 A1 Nov. 14, 2013

(51) Int. Cl.
*A41D 13/008* (2006.01)

(52) U.S. Cl.
CPC ..... *A41D 13/008* (2013.01)

(58) Field of Classification Search
CPC ..... A43B 7/36; A41D 13/08; A63B 71/12; A63B 71/1258; A63B 69/018; A63B 2209/10
See application file for complete search history.

(56) References Cited

U.S. PATENT DOCUMENTS

| | | | | |
|---|---|---|---|---|
| 318,172 | A * | 5/1885 | Delany | 174/5 SB |
| 958,454 | A | 5/1910 | Wirt | |
| 1,940,491 | A * | 12/1933 | Freitag | 174/5 SB |
| 3,317,650 | A * | 5/1967 | Padellford | 174/5 SB |
| 3,416,027 | A | 12/1968 | Amason et al. | |
| 3,596,134 | A * | 7/1971 | Burke | 361/220 |
| 3,857,397 | A * | 12/1974 | Brosseau | 607/149 |
| 3,912,973 | A * | 10/1975 | Young | 361/223 |
| 4,796,153 | A | 1/1989 | Amason et al. | |
| 5,906,004 | A * | 5/1999 | Lebby et al. | 2/1 |
| 6,272,781 | B1 | 8/2001 | Resnick | |
| 7,284,280 | B2 | 10/2007 | Shultz | |
| 7,712,149 | B2 | 5/2010 | Baldwin | |
| 7,817,401 | B2 | 10/2010 | Messer | |
| 7,832,983 | B2 | 11/2010 | Kruckenberg et al. | |
| 7,869,183 | B1 * | 1/2011 | Tan et al. | 361/220 |
| 7,947,773 | B2 | 5/2011 | Hansen et al. | |
| 2006/0230484 | A1 * | 10/2006 | Schultz | 2/2.5 |
| 2007/0271689 | A1 * | 11/2007 | Baldwin | 2/456 |
| 2009/0227162 | A1 * | 9/2009 | Kruckenberg et al. | 442/1 |
| 2010/0083429 | A1 * | 4/2010 | Carraro | 2/456 |
| 2013/0247288 | A1 * | 9/2013 | Kotos | 2/463 |

FOREIGN PATENT DOCUMENTS

| | | | |
|---|---|---|---|
| CN | 2857509 | Y | 1/2007 |
| CN | 102334762 | A | 2/2012 |

OTHER PUBLICATIONS

What makes Carbon Magnetic, Jun. 29, 2015, http://www.ferrocarbon.eu/deliv_b.html.*

(Continued)

*Primary Examiner* — Shaun R Hurley
*Assistant Examiner* — Andrew W Sutton
(74) *Attorney, Agent, or Firm* — Maier & Maier, PLLC

(57) ABSTRACT

A cardiopulmonary lightning protection garment fabricated of an electrically conductive textile, or other suitable body shielding material, forms a fast flashover facilitating, electrical shield of at least an upper portion of the body, and includes a region of reduced conductivity adjacent the wearer's heart. The protective garment also includes a grounding member providing a movable connection between the conductive body shield and a local ground plane. Various configurations of the basic garment are contemplated, including a hooded jacket, hooded raincoat, padded vest, rain poncho, and the like. In various embodiments, the grounding member is a strap-like tail attached to the electrical body shield at an upper end, and having a weighted lower end for maintaining a sliding contact with the ground. In other embodiments, the lower end is attached to a wearer's shoe.

21 Claims, 5 Drawing Sheets

(56) References Cited

OTHER PUBLICATIONS

"Lightning-Associated Deaths—United States, 1980-1995", MMWR 47(19), pp. 391-394, May 22, 1998 (a publication of the Center for Disease Control).

"Deaths Caused by Lightning", Lifschultz, et al., Journal of Forensic Sciences 38(2), pp. 353-358, Mar. 1993.

"Lightning injury caused by discharges accompanying flashovers—a clinical and experimental study of death and survival", Ohashi, et al., in Burns Incl Therm Inj Oct. 1986; 12(7): pp. 496-501.

* cited by examiner

CARDIOPULMONARY LIGHTNING PROTECTION GARMENT

FIELD OF THE INVENTION

The invention relates to protective clothing, and more particularly to garments providing protection against lightning-caused cardiopulmonary arrest.

BACKGROUND ART

Though a rare cause of death, lightning is reported to be responsible for more fatalities each year in this country than any other type of natural disaster. Lightning injuries differ significantly from other high voltage electrical injuries because of the high current flow, but extremely short duration of the lightning strike.

Lightning can affect all organ systems, especially the cardiovascular system. The primary cause of death following a lighting strike is cardiopulmonary arrest. The current in a lightning bolt is as high as 30,000 Amperes at 1,000,000 or more Volts. The short duration of about 1-100 milliseconds limits, but does not prevent serious injury. There are several types of outdoors lightning injury. The most severe is a direct strike, either on the victim or on some object the victim is holding such as a golf club, tripod or umbrella. A "side flash" occurs when lightning hits a nearby object and jumps to the victim. Ground current injuries occur when lightning strikes the ground nearby and spreads to a victim.

Avoidance and prevention are the best means of lightning safety. The risk of a lightning related injury can be minimized with some simple safety measures but not eliminated completely. Just as remaining in a metal vehicle during lightning activity can provide protection, a protective garment that includes an electrically conductive shield can benefit someone who finds himself exposed to a potential lightning strike. What is needed is a protective garment that reduces deaths related to cardiopulmonary arrest following a lightning strike.

Applicant has found no patent nor non-patent literature expressly describing such a garment, however, U.S. Pat. No. 7,712,149 issued to Baldwin in 2010 for a "Protective Article of Outer Clothing" discloses a garment intended for protection against attack by Taser (an electrical stun gun), and suggests (at col. 4, lines 8-12) that such garment might be useful as protection against a lightning strike. The Baldwin garment provides an electrically conductive shield, but lacks any other feature that will benefit the victim of a lightning strike.

Several U.S. patents, in addition to that by Baldwin, disclose electrically conductive textiles of varying types, potentially useful for making electrically protective garments, e.g., U.S. Pat. Nos. 7,947,773, 7,832,983, 7,817,401, 7,284,280, 6,272,781, and 5,906,004. Medical information related to lightning-caused injury and death has been reported in two publications, limited portions of which are paraphrased above: (1) a publication of the Center for Disease Control, "Lightning-Associated Deaths—United States, 1980-1995", MMWR 47 (19), at pages 391-394, May 22, 1998; and (2) a paper titled "Deaths Caused by Lightning", by Lifschultz et al., Journal of Forensic Sciences 38 (2), at pages 353-358, March 1993.

An interesting medical study published in 1986 ["Lightning injury caused by discharges accompanying flashovers—a clinical and experimental study of death and survival", Ohashi M., et al., in *Burns Incl Therm Inj* 1986 October; 12 (7): 496-501, Abstract] reported that "[d]uring the 17 years preceding March 1985, 140 patients sustained lightning injuries caused by 44 thunderbolts. Fifty patients showed evidence of current flow through their bodies. These 50 victims were classified into two groups, the first consisting of 9 victims who showed rupture of their clothes or lineal superficial dermal burns along their whole bodies from head to feet, indicating the occurrence of surface flashovers. The remaining 41 patients showed no evidence of this flash effect. It is noteworthy that in the first group 5 of the 9 survived, whereas in the second group only 6 among 41 survived. The result indicates that when a flashover occurs along the whole body, the probability of survival is higher than 50 percent. The conditions which determine death or survival were investigated experimentally, imposing artificial lightning voltage impulses on rats and developing flashovers on them. The rats survived when the voltage drop caused by flashover occurred immediately after the peak point, and the current waveform exhibited a sharp peak. In contrast, the rats were killed when the voltage drop caused by flashover was delayed by more than 20 microseconds, and the current waveform showed a blunt cone shape. It has been concluded that a fast flashover appreciably diminishes the energy dissipation within the body and consequently results in survival."

No garment that is both practical and wearable can prevent most serious injuries resulting from a lightning strike. A victim will be severely injured. What is needed is a protective garment that can reduce the number of deaths resulting each year from cardiopulmonary arrest following a lightning strike.

It is an object of the present invention to provide a garment that can reduce the number of lightning caused deaths by effectively protecting the user's cardiopulmonary system.

SUMMARY OF THE INVENTION

The above object is achieved by a cardiopulmonary lightning protection garment including a fast flashover facilitating, electrically conductive shield covering at least an upper portion of the body and having a region of limited conductivity for directing electrical charge away from the heart. The garment includes a grounding member providing a movable connection between the garment's conductive shield and a local ground plane, such as the Earth.

The principle of operation of the invention is to shield the body while facilitating fast flashover to reduce electrical potential, conduct the electricity across the garment body, away from the heart, then down the grounding member to the ground plane—or in a reverse direction for a lightning strike that jumps from Earth to sky.

Various configurations of the basic garment are contemplated, including a hooded jacket, hooded raincoat, padded vest, rain poncho, and the like. In various embodiments, the grounding member is a strap-like tail attached to the electrically conductive body shield at an upper end, and falling to the ground at a lower end. A ball or sliding weight is attached to the lower end of the tail to maintain a movable contact between the conductive tail and the ground, and both ball and tail can be stuffed into a garment pocket for carrying when not in use.

List of Reference Symbols in Drawing Figures

| Ref. Symbol | Element Name |
|---|---|
| 100 | Lightning cardiopulmonary protection garment, generally |
| 102 | Garment body (including a conductive body shield) |
| 104 | Garment hood (including a portion of the conductive shield) |
| 106 | Garment pocket |
| 108 | Grounding strap |
| 110 | Weighted end |
| 112 | Local ground plane |
| 200 | Garment cloth including electrically conductive layer, generally |
| 202 | Electrically conductive layer |
| 204, 206 | Cloth layer |
| 300 | Lightning cardiopulmonary protection garment, generally |
| 302 | Electrically conductive body shield |
| 304 | Reduced conductivity heart-protection region |
| 306 | Reduced conductivity material |
| 308 | Garment hood (including portion of conductive shield) |
| 400 | Details of electrical connection, generally |
| 402 | Electrically conductive layer |
| 404 | Ground strap |
| 406 | Electrical connection |
| 408 | Weighted end |
| 410, 412 | Cloth layers |
| 500 | Alternative ground strap configuration, generally |
| 502 | Conductive shield material |
| 504 | Electrical connection |
| 506 | Ground strap |
| 508 | Weighted end |
| 600 | Conductive body shields with reduced conductivity regions, generally |
| 602, 606, 610, 614 | Conductive shield |
| 604, 608, 612, 616 | Low-conductivity region |
| 700 | Lightning cardiopulmonary protection garment, generally |
| 702 | Garment body (including a conductive body shield) |
| 704 | Garment pocket |
| 706 | Grounding strap |
| 708 | Shoe |
| 709 | Heel and sole of shoe |
| 710 | Local ground plane |
| 712 | Lower end of grounding strap |
| 714 | Attachment to heel of shoe |
| 716 | Alternative grounding strap |
| 718 | Tail end of grounding strap |
| 720 | Lower end of alternative grounding strap |
| | END OF LIST |

DESCRIPTION OF THE PREFERRED EMBODIMENT

Figure 1:
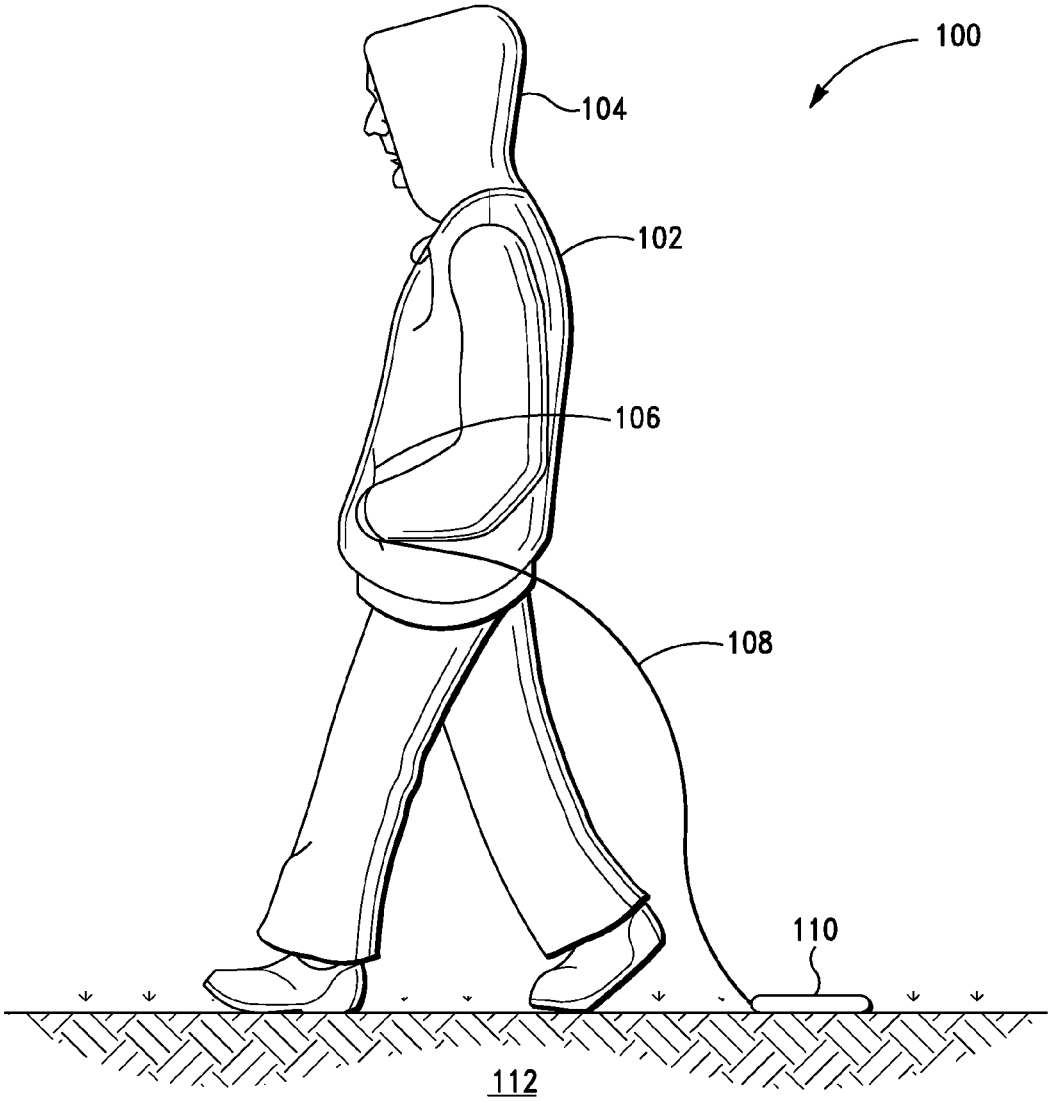
FIG. 1 is a pictorial side view illustrating a cardiopulmonary lightning protection garment providing a fast flashover facilitating, electrically conductive body shield (not illustrated) and a grounding strap with weighted end.

With reference to FIG. 1, there is shown a pictorial side view illustrating a cardiopulmonary lightning protection garment providing a fast flashover facilitating, electrically conductive body shield (not illustrated) and a grounding strap with weighted end. The protective garment is designated generally by reference numeral 100, and includes a garment body 102, a hood 104, pocket 106, and a grounding strap 108 with weighted end 110 in contact with a local ground plane 112. When not in use, grounding strap 108 and weighted end 110 are carried within pocket 106.

In a specific embodiment, garment 100 is manufactured out of cloth so that it appears to be normal clothing, specifically, a hooded jacket as shown in FIG. 1. In this embodiment, the textile out of which the jacket hood, body, and sleeves are constructed includes a fast flashover facilitating, electrically conductive body shield having a heart protection region located at the chest area adjacent to the wearer's heart. Grounding strap 108 is electrically connected at its upper end to the conductive body shield, and in the event of a lightning strike, carries the electrical charge away from the heart, across the shield, and to the local ground plane 112. Weighted end 110 ensures that the grounding strap remains in a sliding contact with local ground plane 112 as the wearer moves about. The contact can also be characterized as movable.

Figure 2:
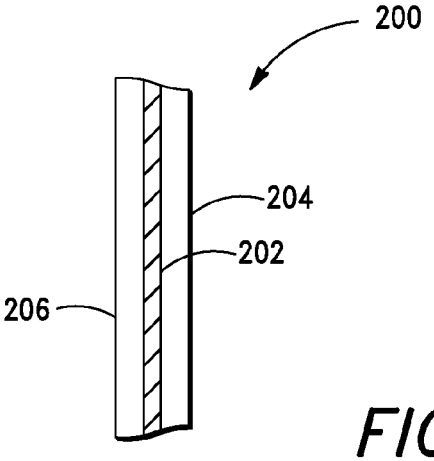
FIG. 2 is a partial side view that illustrates an electrically conductive layer enclosed between cloth layers for use in manufacture of the protective garment of FIG. 1.

FIG. 2 is a partial side view that illustrates an electrically conductive layer enclosed between cloth layers for use in manufacture of the protective garment of FIG. 1. The specific construction detail is designated generally by reference numeral 200, and includes electrically conductive layer 202 sandwiched between cloth layers 204, 206.

Various forms of conductive layer 202 are contemplated including enclosure between cloth layers, as shown in FIG. 2 and taught in U.S. Pat. No. 7,284,280, and as an intermediate layer of the garment as taught in U.S. Pat. No. 6,272,781. Other arrangements with and without additional cloth layers include a textile fabric with integrated electrically conductive fibers as taught in U.S. Pat. No. 5,906,004; a nano-reinforced carbon fiber composite material as taught in U.S. Pat. No. 7,832,983; and a metallic nano-strand conductive composite material as taught in U.S. Pat. No. 7,947,773. The teachings of all US patents cited in this document are incorporated herein by reference.

In various other embodiments, the garment is manufactured from a sandwiched construction such as illustrated in FIG. 2. The electrically conductive layer 202 forms a fast flashover facilitating, electrically conductive body shield by having seams of the garment join adjacent parts of the conductive layer 202 so that the resulting garment forms an electrically conductive entity.

Figure 3:
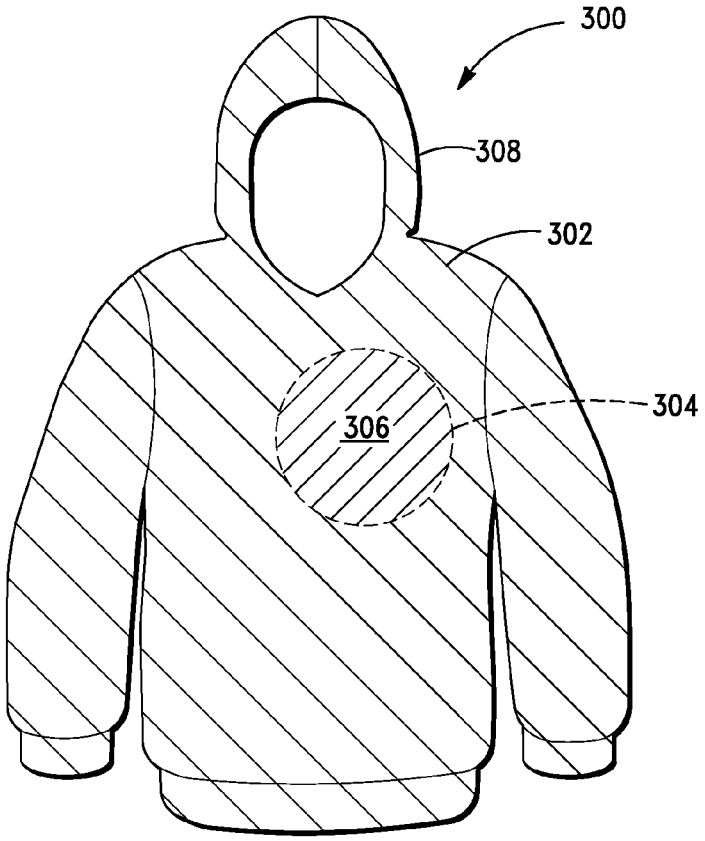
FIG. 3 is a partial front view illustrating a region of the conductive body shield having a reduced conductivity in the vicinity of the heart.

FIG. 3 is a partial front view illustrating a region of the conductive body shield having a reduced conductivity in the vicinity of the heart. The details of the body shield and the reduced conductivity region are designated generally by reference numeral 300 and include an electrically conductive body shield 302 having a reduced conductivity heart-protection region 304 covered by a reduced conductivity material 306, and garment hood 308 also including a portion of the body shield 302.

In various embodiments, the body shield 302 is made of the electrically conductive layer 202 of FIG. 2 and, in the specific embodiment illustrated in FIG. 3, encloses the torso body, hood and sleeves of the garment 300. The parts from which the body shield is constructed are connected at the construction seams to form an electrically conductive whole. A region adjacent to the wearer's heart (circular area 304 inside the dashed line at the left side of the chest) is made of a material 306 having a reduced electrical conductivity as compared with the conductivity of the remainder of the body shield 302. In some embodiments the body shield 302 has a first level of conductivity while the heart-protection region 304 has a second level of conductivity—a region of reduced conductivity. In other embodiments, the region 304 near the heart is a void in the body shield, and thus has zero conductivity. The purpose of the heart-protection region is to direct the intense lightning charge of short duration away from the heart, without interfering with the facilitating of a fast flashover, to prevent or lessen the chance of cardiopulmonary arrest.

Figure 4:
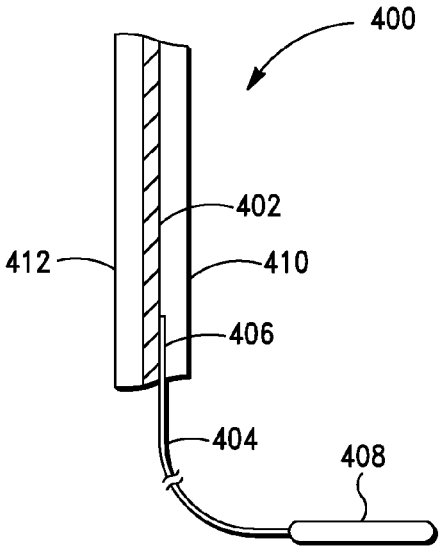
FIG. 4 is a partial side view illustrating an electrical connection between a conductive body shield and a grounding strap made of a flexible conductor, and illustrating a weighted end.

FIG. 4 is a partial side view illustrating an electrical connection between a conductive body shield and a grounding strap made of a flexible conductor, and illustrating a weighted end. Details of the electrical connection are designated generally by reference numeral 400, and include electrically conductive layer 402, ground strap 404, electrical connection 406, weighted end 408, and cloth layers 410, 412. The electrical connection between the conductive layer 402, used to form the conductive body shield, and the ground strap 404, completes an electrical circuit permitting the ground strap 404 to carry the lightning charge from the body shield down to ground (112 of FIG. 1).

Figure 5:
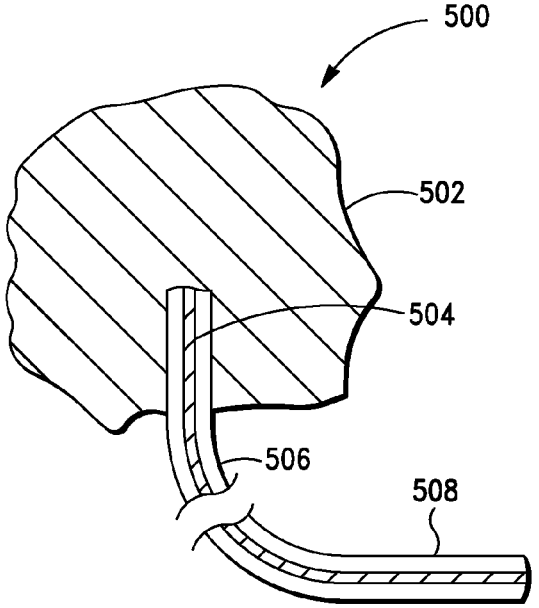
FIG. 5 is a partial plan view that illustrates an alternative configuration for a grounding strap made of a cloth-covered extension of the conductive body shield, and illustrating a weighted end.

FIG. 5 is a partial plan view that illustrates an alternative configuration for a grounding strap made of a cloth-covered extension of the conductive body shield, and illustrating a weighted end. Details of the alternative grounding strap configuration are designated generally by the reference numeral 500, and include conductive shield material 502, electrical connection 504, ground strap 506, and weighted end 508. This configuration replaces the flexible conductor 404 of FIG. 4 with a cloth strap having an internal electrical conductor such as the conductive layer 202 of FIG. 2. The strap and its weighted end are carried in a garment pocket when not in use. An alternative embodiment allows the weighted end 508 to be attached inside the garment using Velcro®, an ordinary button, or like attachment (not illustrated), e.g., attached up inside to a garment inner lining. In general, non-metallic fasteners are preferred because of the extreme voltages present during a lightning strike.

FIGS. 6A-6D illustrate alternative arrangements of a low-conductivity region near the heart. The figures illustrate a front chest region of a body shield and region of low conductivity. The various low-conductivity regions are designated generally by reference numeral 600 and include high-conductivity shields 602, 606, 610, and 614, and regions of low conductivity 604, 608, 612, and 616, respectively.

Figure 6A:
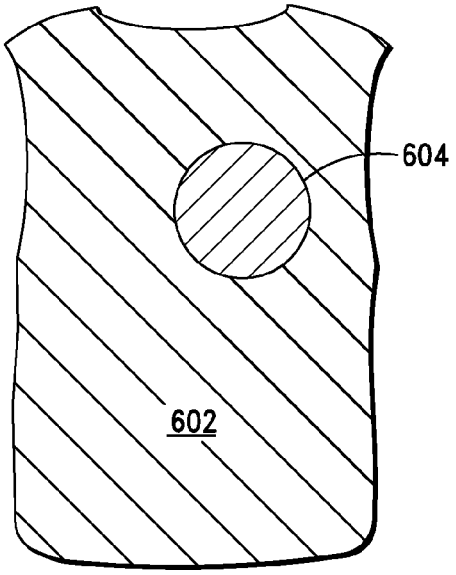
FIGS. 6A-6D illustrate alternative arrangements of a reduced conductivity region near the heart.
Figure 6B:
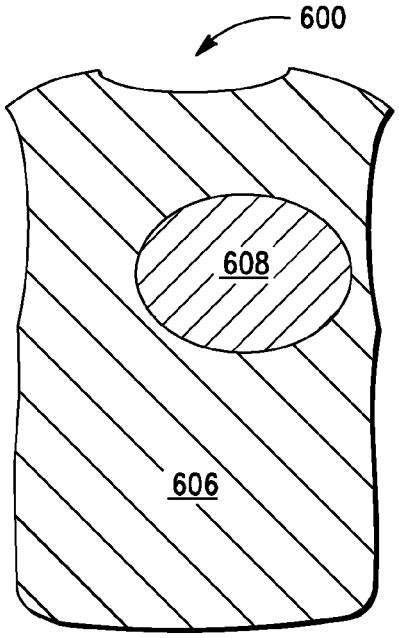
Figure 6C:
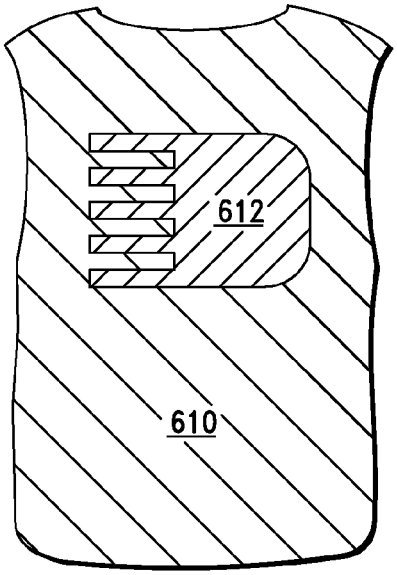
Figure 6D:
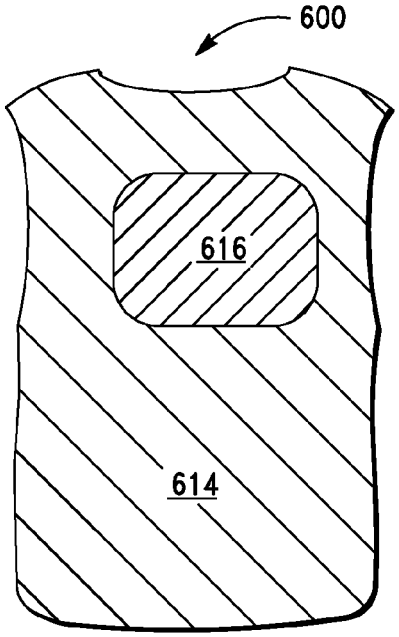

One variation in the regions of low-conductivity is that they are of different size and shape. In particular, the region 612 in FIG. 6C is open adjacent to the wearer's heart on the center-left side of the chest area and includes rib-like horizontal extensions of the conductive body shield 610 on the right side of the chest.

Figure 7A:
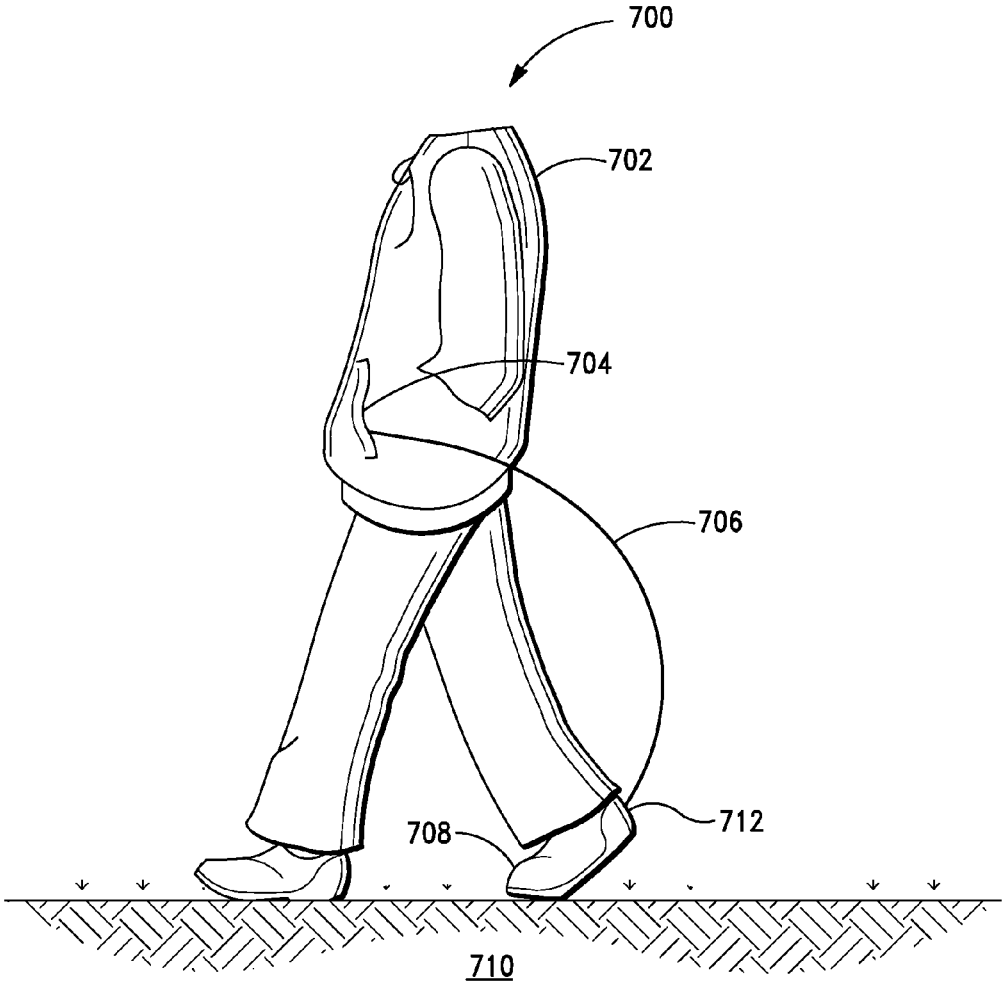
FIGS. 7A-7C illustrate an alternative construction for the lower end of the grounding strap, that is here shown attached to the heel of the shoe rather than having a weighted lower end.
Figure 7B:
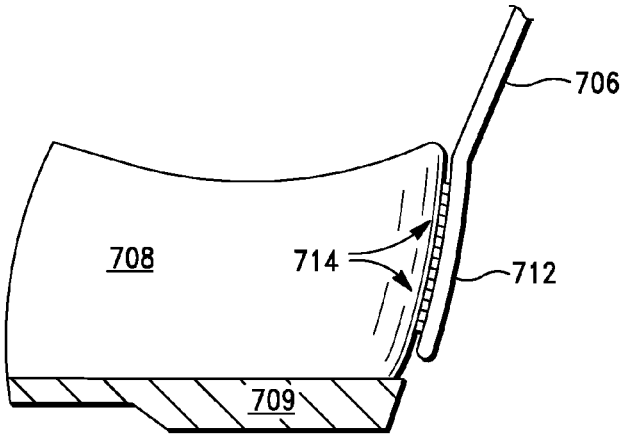
Figure 7C:
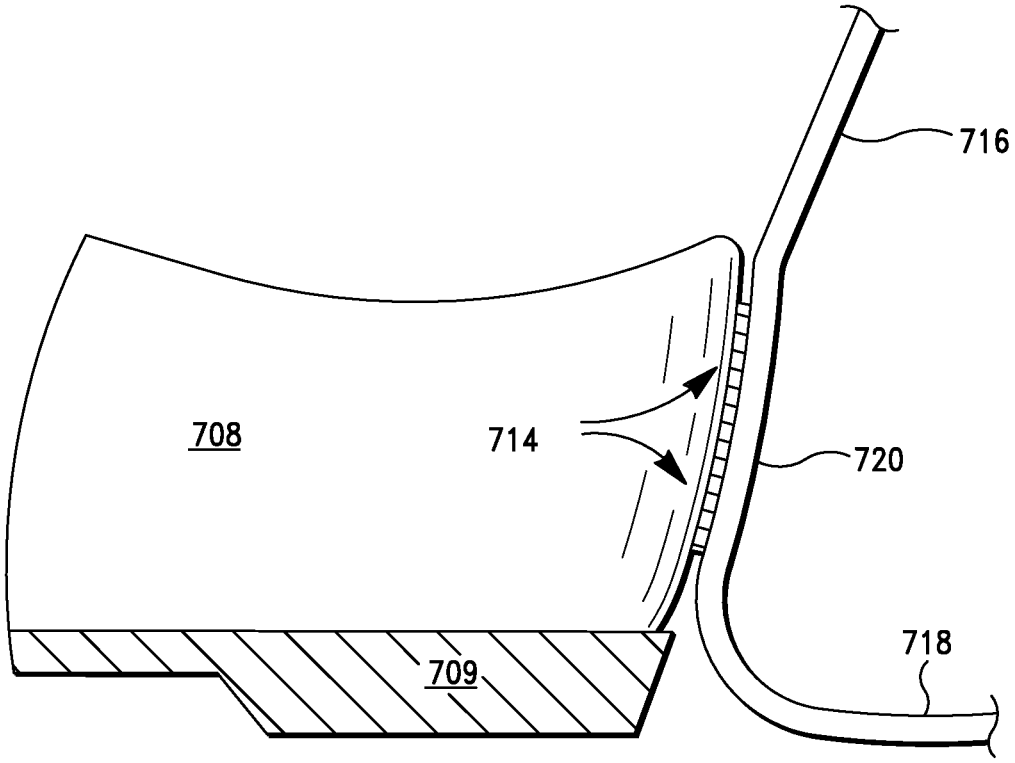

FIGS. 7A-7C illustrate an alternative construction for the lower end of the grounding strap, that is here shown attached to the heel of the shoe rather than having a weighted lower end. FIG. 7A illustrates a lightning cardiopulmonary protection garment that is indicated generally by the reference numeral 700, and includes a garment 702 having a conductive body shield (not illustrated), a garment pocket 704, an alternative grounding strap 706 attached 712 to the heel of shoe 708, and illustrating a local ground plane 710. The electrical contact with the local ground plane is more intermittent than sliding, when this alternative construction is used. The contact can also be characterized as movable.

FIG. 7B is a partial side view of shoe 708 of FIG. 7A showing heel and sole 709, and a lower end 712 of alternative grounding strap 706 attached to the heel region of shoe 708 by means of attachment 714, such as Velcro®. Various embodiments of attachment 714 are not electrically conductive, for example, the Velcro® attachment. Nor, in general, are the heel and sole 709 of the shoe conductive. Other embodiments of shoes having electrically conductive heels, soles, and/or metal spikes, such as golf shoes (not illustrated), are also contemplated.

FIG. 7C illustrates an alternative grounding strap 716 including a tail portion 718 at the extreme lower end. In various embodiments, the grounding strap 716 is made of, or includes, electrically conductive material that extends into the region 718 and drags along the local ground plane (not illustrated). When spiked shoes are worn, the tail region 718 can be attached by pressing spikes near the rear region of heel 709 through a portion of the tail region 718 that is allowed to extend under the heel of the shoe (not illustrated). In another variation, the conductive grounding strap 706 connecting the body shield with the heel of shoe 708 is doubled, one strap for each shoe, to distribute the charge equally between both legs (FIG. 7A). In another variation, a wire or other conductive strap connects the heels of both shoes (not illustrated) while permitting normal movement.

In other embodiments of the protective shield (e.g., FIGS. 6A-6D), the region of low-conductivity (e.g., 604 of FIG. 6A) is made of a material having a significantly lower conductivity than the surrounding protective shield (602). The purpose of the shield is to facilitate a fast flashover, and to collect the electrical charge and direct it away from the region of the heart and to the grounding member (e.g., 108 of FIG. 1) that is making contact with a local ground plane (Earth), either directly or through the shoe (FIG. 7A).

Use of a material of low conductivity in the region near the heart helps direct the charge away from the heart. In various embodiments that use a low-conductivity material in the heart region, the low-conductivity material is electrically connected at its edges to the higher-conductivity of the surrounding regions (not illustrated). In other embodiments, the low-conductivity region is created as a conductive void in the material of the protective shield. The phrase "conductive void" as used here refers to a hole—an absence of conductive material in the body shield. The cloth, of course, remains covering the heart region so that the garment appears natural. In another variation (not illustrated) the body shield does not include a region of reduced conductivity near the heart; instead, the protective body shield also covers the heart region with high conductivity material, and relies instead upon facilitating a fast flashover and electrical body shielding for protection.

While the invention has been described in relation to the embodiments shown in the accompanying Drawing figures, other embodiments, alternatives and modifications will be apparent to those skilled in the art. It is intended that the Specification be exemplary only, and that the true scope and spirit of the invention be indicated by the following Claims.

The invention claimed is:

1. An article of manufacture, comprising:

a garment for covering at least an upper portion of a wearer's body; and at least one electrically conductive element disposed on the garment for promoting and sustaining a fast flashover event, the at least one electrically conductive element being formed of a metallic nano-strand conductive composite material containing metallic nano-strands.

2. The article of manufacture of claim 1, further comprising the at least one electrically conductive element being formed of a fabric having integrated electrically conductive fibers.

3. The article of manufacture of claim 2, wherein the fabric having integrated electrically conductive fibers includes regions of reduced electrical conductivity.

4. The article of manufacture of claim 3, further comprising the regions of reduced electrical conductivity including a predetermined percentage of reduced conductivity material supporting the electrically conductive fibers.

5. The article of manufacture of claim 1, further comprising the at least one electrically conductive element being formed of a nano-reinforced carbon fiber composite material.

6. The article of manufacture of claim 5, wherein the nano-reinforced carbon fiber composite material includes regions of reduced electrical conductivity.

7. The article of manufacture of claim 6, further comprising the regions of reduced electrical conductivity including a predetermined percentage of reduced conductivity material supporting the nano-reinforced carbon fibers.

8. The article of manufacture of claim 1, wherein the metallic nano-strand conductive composite material includes regions of reduced electrical conductivity.

9. The article of manufacture of claim 8, further comprising the regions of reduced electrical conductivity including a predetermined percentage of reduced conductivity material supporting the metallic nano-strand conductive elements.

10. The article of manufacture of claim 1, further comprising the metallic nano-strand conductive composite material including larger electrically conductive fibers.

11. The article of manufacture of claim 1, further comprising the metallic nano-strands being magnetic, and aligned parallel with a line extending between a collar region and a waist region of the garment.

12. The article of manufacture of claim 1, further comprising the metallic nano-strands being magnetic, and aligned parallel with a line extending between first and second shoulder regions of the garment.

13. The article of manufacture of claim 1, further comprising the at least one electrically conductive element including at least one region of reduced electrical conductivity.

14. The article of manufacture of claim 1, further comprising the at least one electrically conductive element being disposed within a region of reduced electrical conductivity.

15. The article of manufacture of claim 14, further comprising a plurality of electrically conductive elements being disposed within at least one region of reduced electrical conductivity.

16. The article of manufacture of claim 15, further comprising the plurality of electrically conductive elements being disposed on the garment generally parallel with a line between a collar region and a waist region of the garment.

17. The article of manufacture of claim 1, further comprising one of a jacket, coat, suit coat, topcoat, sweater, vest, sweater-vest, sweatshirt, raincoat, and poncho.

18. The article of manufacture of claim 1, further comprising the at least one electrically conductive element being located between cloth layers of the garment.

19. The article of manufacture of claim 1, further comprising the at least one electrically conductive element being disposed on an intermediate layer of the garment.

20. The article of manufacture of claim 1, further comprising the garment including a textile layer that is one of a waterproof, and a water-resistant textile layer.

21. The article of manufacture of claim 1, further comprising the garment including a textile layer that is one of a fireproof, and a fire-retardant textile layer.

* * * * *